US006931689B2

(12) United States Patent
Huang

(10) Patent No.: US 6,931,689 B2
(45) Date of Patent: Aug. 23, 2005

(54) FACE BRUSH

(75) Inventor: Min-Tsung Huang, 58, Ma Yuan West, St. Taichung (TW)

(73) Assignee: Min-Tsung Huang, Taichung (TW)

( * ) Notice: Subject to any disclaimer, the term of this patent is extended or adjusted under 35 U.S.C. 154(b) by 259 days.

(21) Appl. No.: 10/452,597

(22) Filed: May 29, 2003

(65) Prior Publication Data

US 2004/0237238 A1 Dec. 2, 2004

(51) Int. Cl.[7] ..... A47K 7/02
(52) U.S. Cl. ..... 15/209.1; 15/229.13
(58) Field of Search ..... 15/209.1, 229.11, 15/229.13, 229.12, 222, 229.14, 110, 176.1–176.6; 300/21; 601/135, 137, 138

(56) References Cited

U.S. PATENT DOCUMENTS 6,276,022 B1 * 8/2001 Gallacher ..... 15/209.1
6,370,723 B1 * 4/2002 Chang ..... 15/110
6,510,577 B1 * 1/2003 Borcherds et al. ..... 15/118
2002/0166189 A1 * 11/2002 Huang ..... 15/209.1
2003/0051304 A1 * 3/2003 Chang ..... 15/209.1

* cited by examiner

*Primary Examiner*—John Kim
*Assistant Examiner*—Shay L. Balsis
(74) *Attorney, Agent, or Firm*—Alan D. Kamrath; Nikolai & Mersereau, P.A.

(57) ABSTRACT

A face brush has a holding frame, a thread girdle, and a tube-shaped elastic net. The holding frame has a handle and a disk-shaped head having a semispheric center protrusion. A through aperture is formed on the semi-spheric center protrusion of the disk-shaped head. The thread girdle is folded into a two-ply yarn to be inserted through the through aperture. The tube-shaped elastic net surrounds two parallel posts. The semispheric center protrusion contacts the tube-shaped elastic net. The thread girdle surrounds the tube-shaped elastic net to squeeze and to bind the tube-shaped elastic net. Two ends of the thread girdle are bound to form a connecting knot. The tube-shaped elastic net is detached from the posts to form a product.

4 Claims, 10 Drawing Sheets

FACE BRUSH

BACKGROUND OF THE INVENTION

The present invention relates to a face brush. More particularly, the present invention relates to a face brush which is easily assembled.

Referring to FIGS. 1 to 3, a conventional face brush has a holding frame 20, a thread girdle 30, and a tube-shaped elastic net 10. The holding frame 20 has a handle 21 having an end hole 211, and a ring-shaped head 22 having a center groove 221 and three periphery apertures 222. The tube-shaped elastic net 10 surrounds two posts 40 which are disposed on a plate 4. The thread girdle 30 is inserted through one of the three periphery apertures 222 of the ring-shaped head 22 to enclose the tube-shaped elastic net 10. Then the thread girdle 30 winds and squeezes the tube-shaped elastic net 10. After the thread girdle 30 is inserted through all of the three periphery apertures 222 of the ring-shaped head 22, two ends of the thread girdle 30 are bound to form a connecting knot. Then the tube-shaped elastic net 10 is detached from the posts 40. FIG. 2*g* illustrates a perspective view of the conventional face brush, and FIG. 3 illustrates a sectional view of the conventional face brush. Since the periphery apertures 222 of the ring-shaped head 22 are not formed on a bottom of the ring-shaped head 22, the thread girdle 30 cannot fasten the tube-shaped elastic net 10 stably. The tube-shaped elastic net 10 will be slided while a user uses the conventional face brush. Since a portion of the tube-shaped elastic net 10 will contact a center portion of the ring-shaped head 22, it is difficult to wind the tube-shaped elastic net 10 with the thread girdle 30.

SUMMARY OF THE INVENTION

An object of the present invention is to provide a face brush which is easily assembled.

Another object of the present invention is to provide a face brush which has a thread girdle to fasten a tube-shaped elastic net on a semispheric center protrusion of a disk-shaped head of a holding frame stably so that the tube-shaped elastic net will not be slided while a user uses the face brush.

Accordingly, a face brush comprises a holding frame, a thread girdle, and a tube-shaped elastic net. The holding frame has a handle having an end hole, and a disk-shaped head having a semispheric center protrusion. A through aperture is formed on the semispheric center protrusion of the disk-shaped head. The thread girdle is folded into a two-ply yarn to be inserted through the through aperture of the semispheric center protrusion of the disk-shaped head. The tube-shaped elastic net surrounds two parallel posts. The semispheric center protrusion contacts the tube-shaped elastic net. The thread girdle surrounds the tube-shaped elastic net to squeeze and to bind the tube-shaped elastic net. Two ends of the thread girdle are bound to form a connecting knot. The tube-shaped elastic net is detached from the parallel posts to form a product.

DETAILED DESCRIPTION OF THE INVENTION

Figure 1:
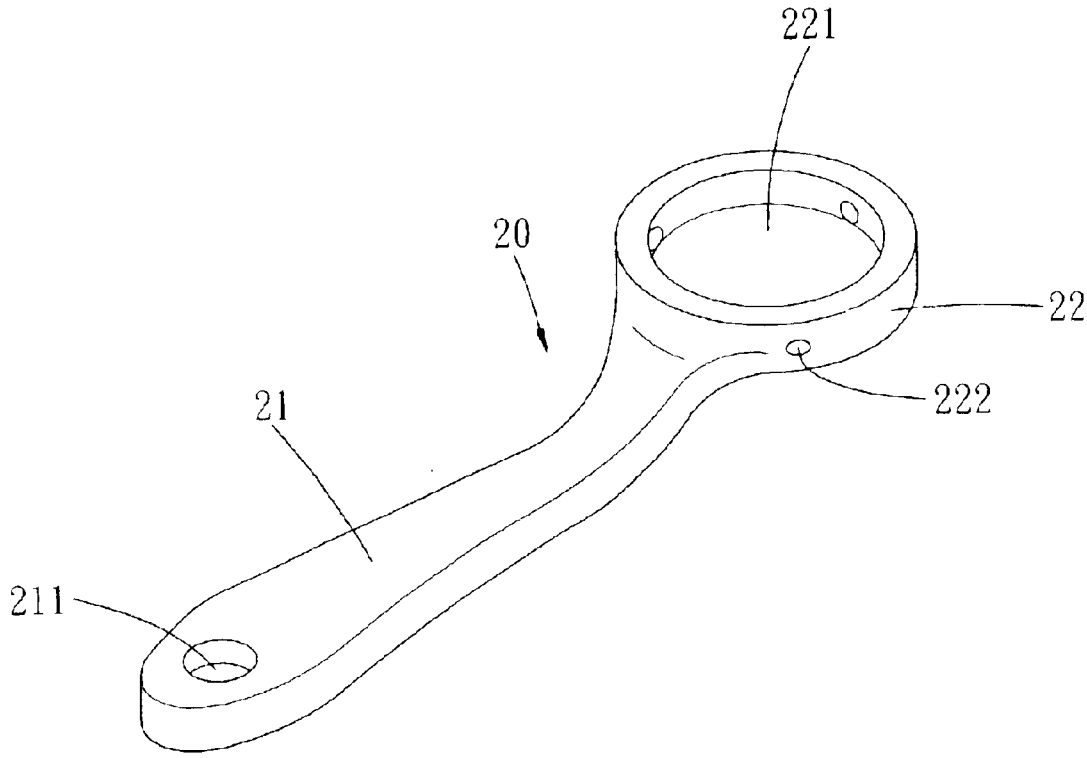
FIG. 1 PRIOR ART
FIG. 1 is a perspective view of a holding frame of the prior art.
Figure 2A:
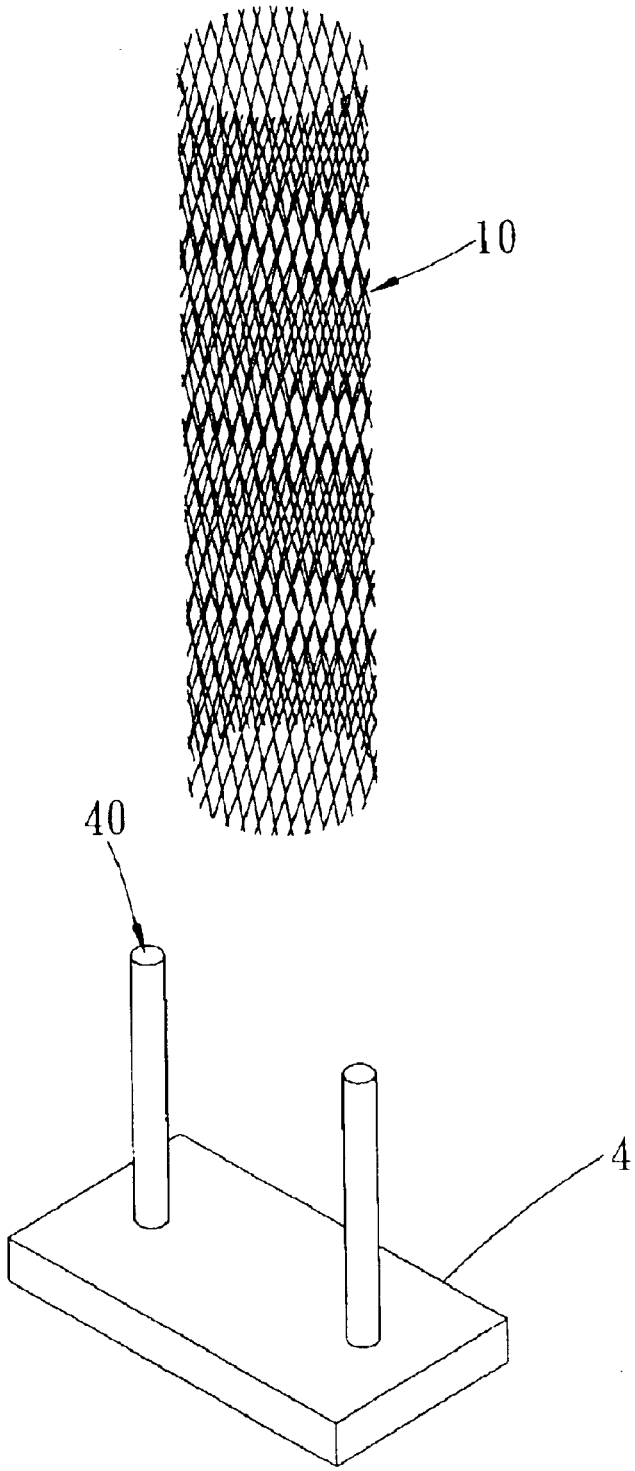
FIG. 2a PRIOR ART
FIG. 2*a* is a perspective schematic view illustrating a tube-shaped elastic net and two posts of a plate of the prior art.
Figure 2B:
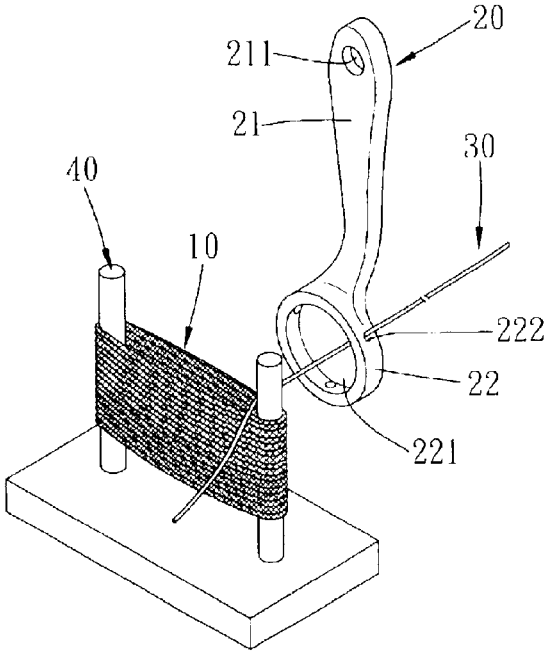
FIG. 2b PRIOR ART
FIG. 2*b* is a perspective schematic view illustrating a first step of making a conventional face brush of the prior art.
Figure 2D:
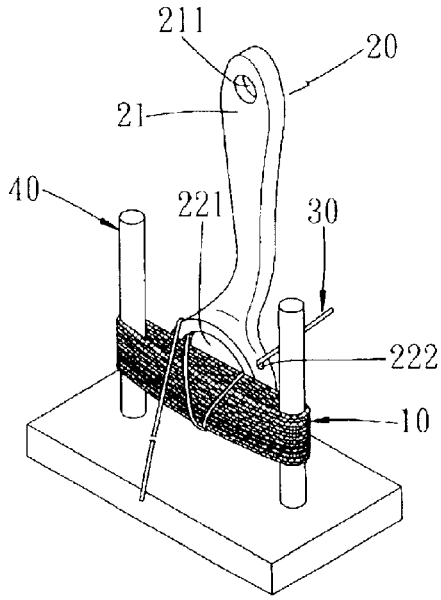
FIG. 2d PRIOR ART
FIG. 2*d* is a perspective schematic view illustrating a third step of making a conventional face brush of the prior art.
Figure 2C:
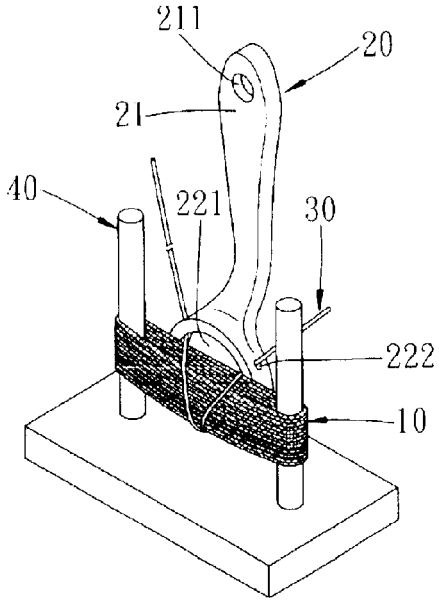
FIG. 2c PRIOR ART
FIG. 2*c* is a perspective schematic view illustrating a second step of making a conventional face brush of the prior art.
Figure 2E:
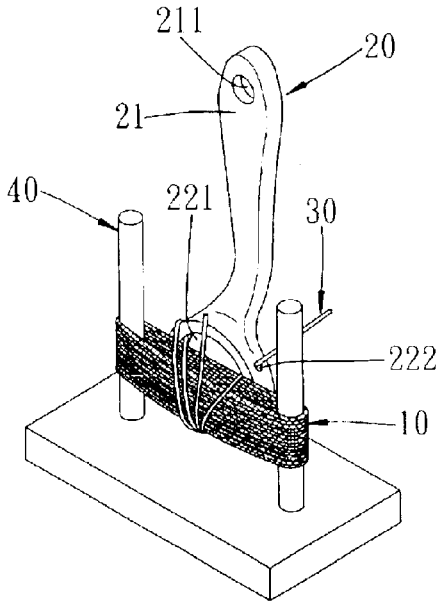
FIG. 2e PRIOR ART
FIG. 2*e* is a perspective schematic view illustrating a fourth step of making a conventional face brush of the prior art.
Figure 2F:
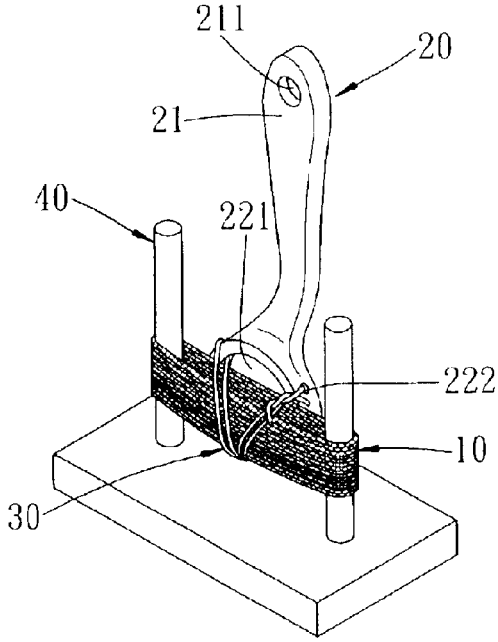
FIG. 2f PRIOR ART
FIG. 2*f* is a perspective schematic view illustrating a fifth step of making a conventional face brush of the prior art.
Figure 2G:
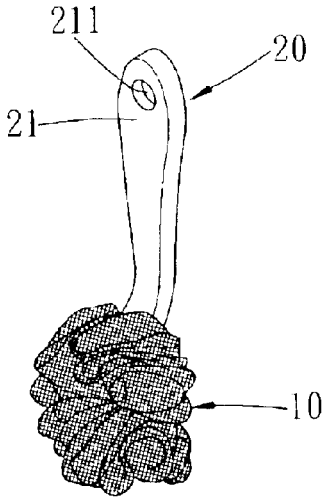
FIG. 2g PRIOR ART
FIG. 2*g* is a perspective schematic view illustrating a sixth step of making a conventional face brush of the prior art.
Figure 3:
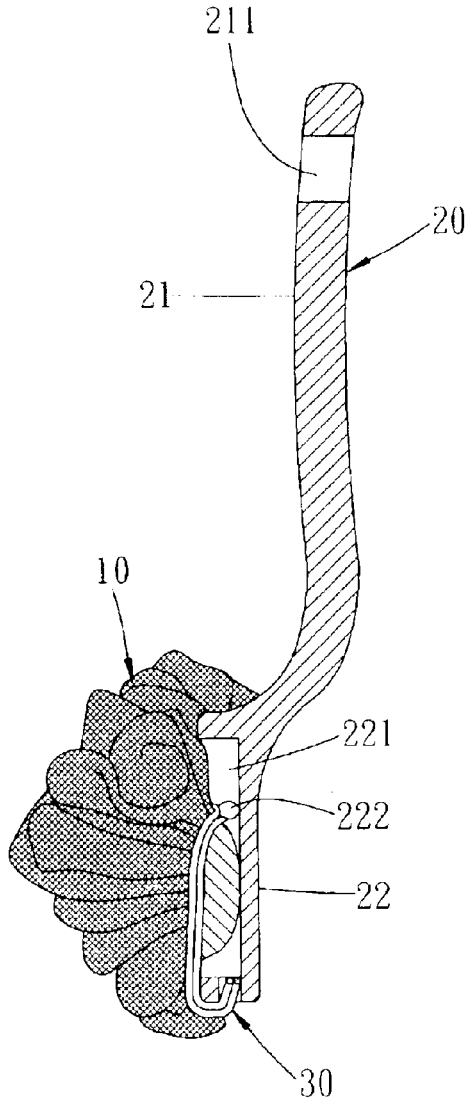
FIG. 3 PRIOR ART
FIG. 3 is a sectional assembly view of a conventional face brush of the prior art.
Figure 4:
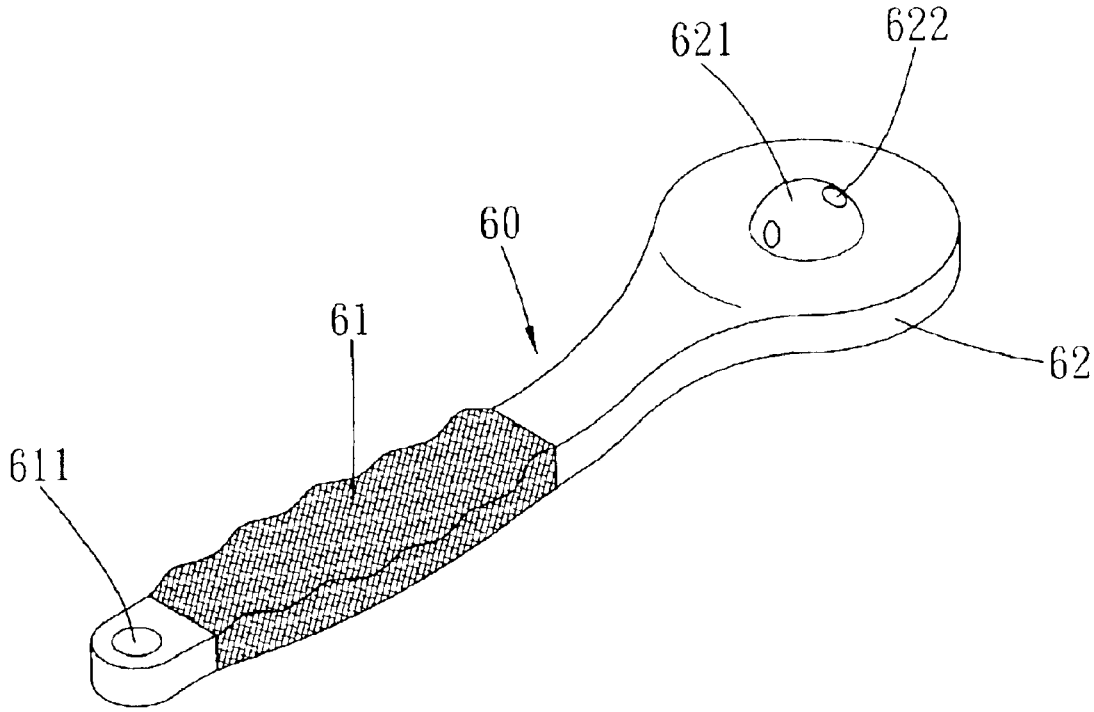
FIG. 4 is a perspective view of a holding frame of a first preferred embodiment in accordance with the present invention.
Figure 5A:
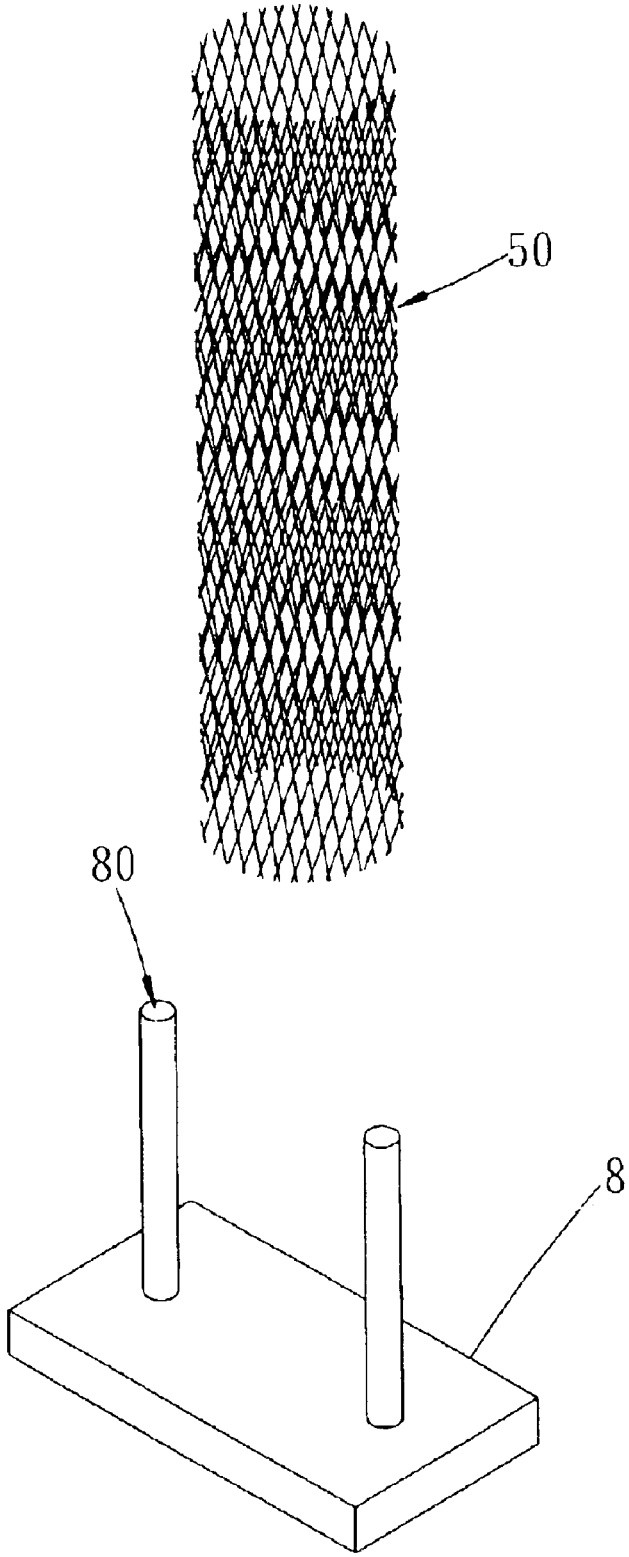
FIG. 5*a* is a perspective schematic view illustrating a tube-shaped elastic net and two posts of a plate of a first preferred embodiment in accordance with the present invention.
Figure 5B:
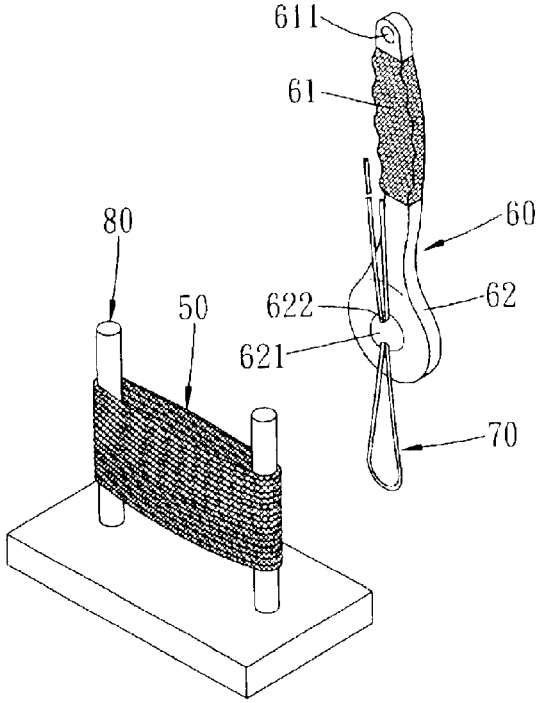
FIG. 5*b* is a perspective schematic view illustrating a first step of making a face brush of a first preferred embodiment in accordance with the present invention.
Figure 5D:
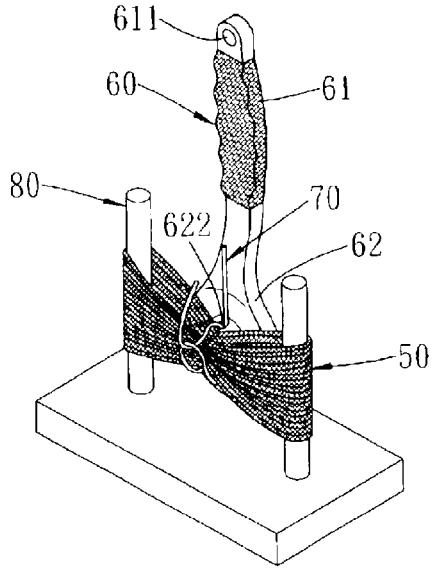
FIG. 5*d* is a perspective schematic view illustrating a third step of making a face brush of a first preferred embodiment in accordance with the present invention.
Figure 5C:
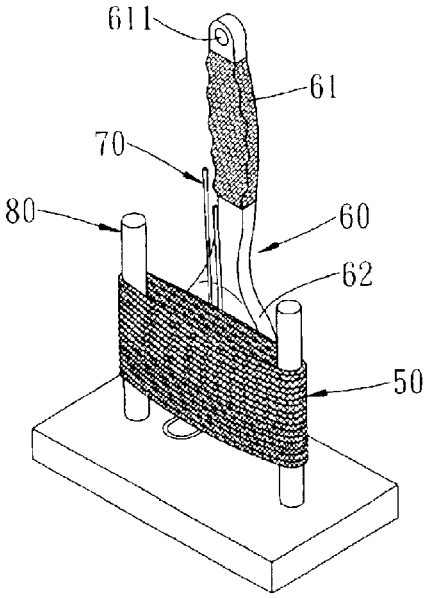
FIG. 5*c* is a perspective schematic view illustrating a second step of making a face brush of a first preferred embodiment in accordance with the present invention.
Figure 5E:
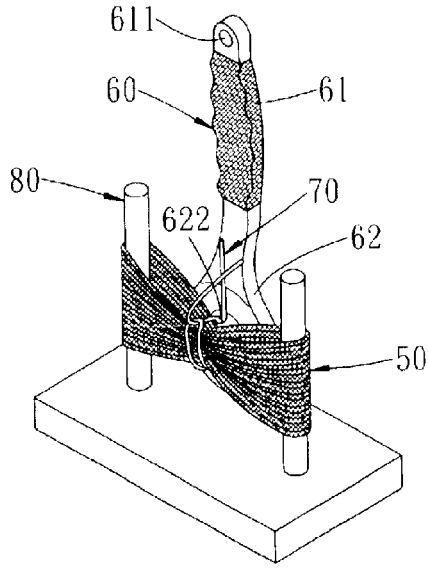
FIG. 5*e* is a perspective schematic view illustrating a fourth step of making a face brush of a first preferred embodiment in accordance with the present invention.
Figure 5F:
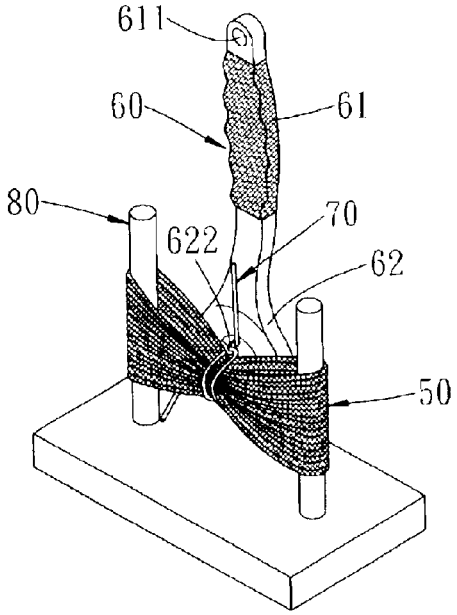
FIG. 5*f* is a perspective schematic view illustrating a fifth step of making a face brush of a first preferred embodiment in accordance with the present invention.
Figure 5H:
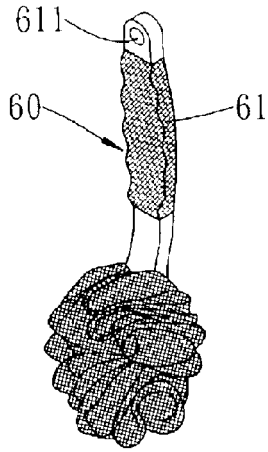
FIG. 5*h* is a perspective schematic view illustrating a seventh step of making a face brush of a first preferred embodiment in accordance with the present invention.
Figure 5G:
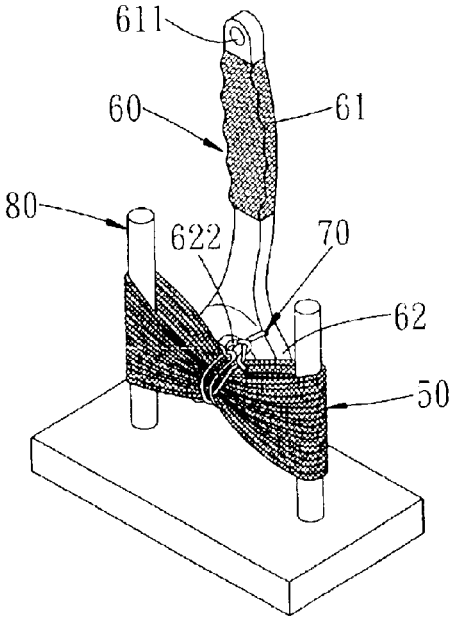
FIG. 5*g* is a perspective schematic view illustrating a sixth step of making a face brush of a first preferred embodiment in accordance with the present invention.
Figure 6:
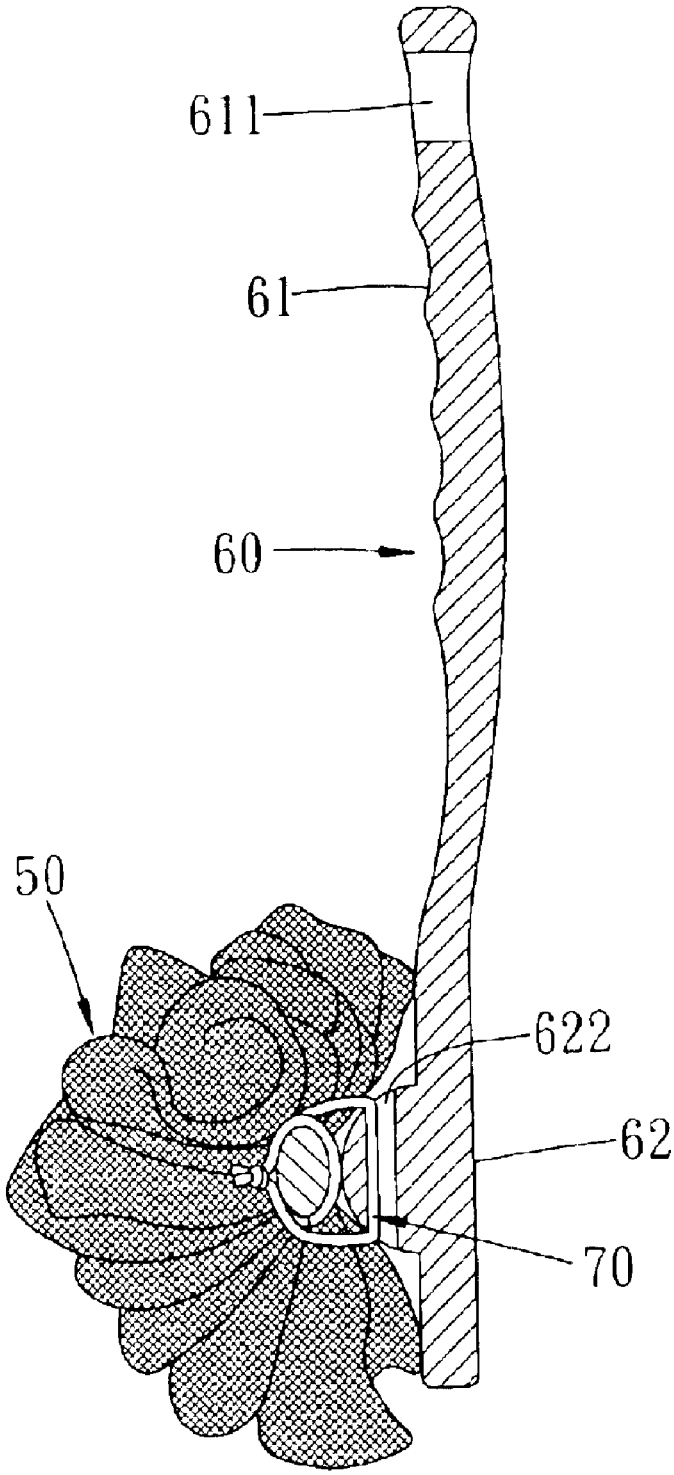
FIG. 6 is a sectional assembly view of a face brush of a first preferred embodiment in accordance with the present invention.

Referring to FIGS. 4 to 6, a first face brush comprises a holding frame 60, a thread girdle 70, and a tube-shaped elastic net 50.

The tube-shaped elastic net 50 has a large number of meshes.

The tube-shaped elastic net 50 is made of a plastics material.

The holding frame 60 has a handle 61 having an end hole 611, and a disk-shaped head 62 having a semispheric center protrusion 621.

A through aperture 622 is formed on the semispheric center protrusion 621 of the disk-shaped head 62.

Referring to FIGS. 5*b* to 5*h* again, the thread girdle 70 is folded into a two-ply yarn to be inserted through the through aperture 622 of the semispheric center protrusion 621 of the disk-shaped head 62.

The tube-shaped elastic net 10 surrounds two posts 80 which are disposed on a plate 8.

The semispheric center protrusion 621 contacts the tube-shaped elastic net 10.

The thread girdle 70 surrounds the tube-shaped elastic net 10 to squeeze and to bind the tube-shaped elastic net 10.

Two ends of the thread girdle 70 are bound to form a connecting knot.

The tube-shaped elastic net 50 is detached from the posts 80 to form a product.

Referring to FIG. 6 again, the first face brush is assembled.

The present invention has the following advantages. Because the semispheric center protrusion contacts the tube-shaped elastic net directly, the tube-shaped elastic net will not hinder a winding operation of the thread girdle. Therefore, the face brush is easily assembled. The thread girdle fastens the tube-shaped elastic net on the semispheric center protrusion of the disk-shaped head of the holding frame stably, so the tube-shaped elastic net will not be slided while a user uses the face brush.

Figure 7:
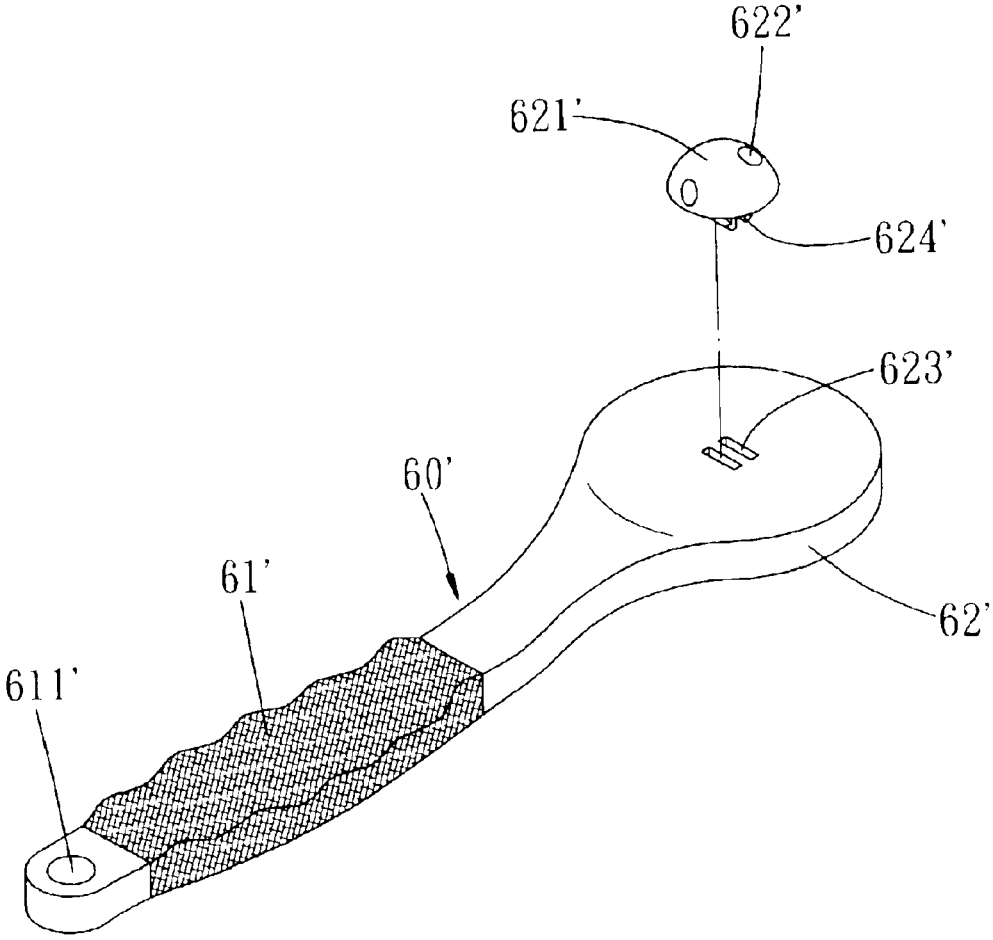
FIG. 7 is a perspective view of a holding frame of a second preferred embodiment in accordance with the present invention.

Referring to FIG. 7, a second holding frame 60' comprises a handle 61' having an end hole 611', a disk-shaped head 62' having a pair of oblong holes 623', and a center block 621' having a through aperture 622' and two lower click bars 624'.

Each of the lower click bars 624' is inserted in the corresponding oblong hole 623' of the disk-shaped head 62'.

It is easy to assemble the center block 621' and the disk-shaped head 62' by inserting each lower click bar 624' in the corresponding oblong hole 623' of the disk-shaped head 62'.

It is easy to manufacture the second holding frame 60' also.

The present invention is not limited to the above embodiment but various modification thereof may be made. Furthermore, various changes in form and detail may be made without departing from the scope of the present invention.

I claim:

1. A face brush comprises:

a holding frame, a thread girdle, and a tube-shaped elastic net, the holding frame having a handle having an end hole, and a disk-shaped head having a semispheric center protrusion, a through aperture formed on the semispheric center protrusion of the disk-shaped head, the thread girdle folded into a two-ply yarn to be inserted through the through aperture of the semispheric center protrusion of the disk-shaped head, the tube-shaped elastic net surrounding two parallel posts, the semispheric center protrusion contacting the tube-shaped elastic net, the thread girdle surrounding the tube-shaped elastic net to squeeze and to bind the tube-shaped elastic net, two ends of the thread girdle being bound to form a connecting knot, and the tube-shaped elastic net detached from the parallel posts to form a product.

2. The face brush as claimed in claim 1, wherein the tube-shaped elastic net has a large number of meshes.

3. The face brush as claimed in claim 1, wherein the tube-shaped elastic net is made of a plastics material.

4. The face brush as claimed in claim 1, wherein the disk-shaped head has a pair of oblong holes.

* * * * *